United States Patent [19]

Hernandez

[11] Patent Number: 4,835,798

[45] Date of Patent: Jun. 6, 1989

[54] BASKET SINK STRAINER CENTERING TOOL

[76] Inventor: Benito B. Hernandez, 4241 NW. 27th St., Fort Lauderdale, Fla. 33313

[21] Appl. No.: 194,895

[22] Filed: May 17, 1988

[51] Int. Cl.[4] ..... E03C 1/00

[52] U.S. Cl. ..... 4/661; 4/286

[58] Field of Search ..... 4/286, 287, 288, 290, 4/291, 292, DIG. 9, 637, 657, 661, 295; 81/176.1, 176.15, 462, 44, DIG. 1, DIG. 4; 254/133 R, 102; 269/296; 33/644, 673, 671, 670; 29/464, 468; 271/226, 232; 82/45

[56] References Cited

U.S. PATENT DOCUMENTS 2,894,263 7/1959 Kunkel ..... 4/661

3,318,010 5/1967 Mahl ..... 33/673

*Primary Examiner*—Henry J. Recla

*Assistant Examiner*—Glenn T. Barrett

*Attorney, Agent, or Firm*—Walter F. Wessendorf, Jr.

[57] ABSTRACT

A centering tool for disposing and maintaining a basket sink strainer in concentric and superposed parallel relationships with respect to a sink drain hole for subsequent assembled securement of the sink strainer. The centering tool comprises a tubular spider of upper and lower horizontal arms, normal to each other, telescopically mounting extensible tubular elements that are adjustably positionable for contact with the lateral corners of the sink. An adapter member, depending from the center of the spider's lower arm, carries a pronged adapter element that complementally engages arcuate slots in the bottom well of the sink strainer. Vertically disposed tubular feet, depending from the arms, rest upon the bottom surface of the sink.

18 Claims, 3 Drawing Sheets

FIG. 2
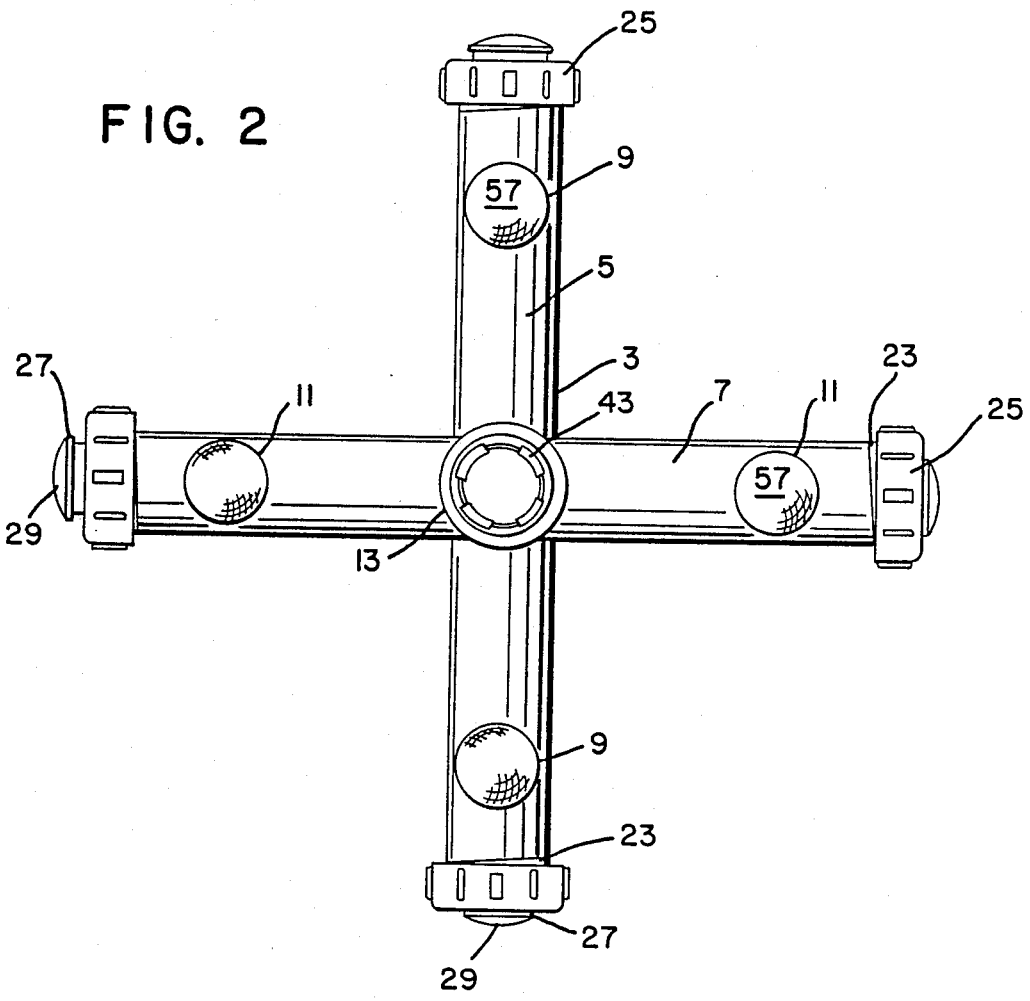
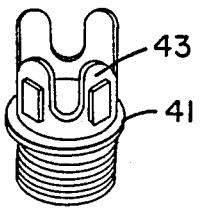
FIG. 4

BASKET SINK STRAINER CENTERING TOOL

BACKGROUND OF THE INVENTION

1. Technical Field

This invention relates to a basket sink strainer centering tool for use in disposing and maintaining a basket sink strainer in concentric and superposed parallel relationships with respect to the sink drain hole of a kitchen sink for subsequent securement of such basket sink strainer with such sink drain hole by tightening engagement of a large female-threaded ring with the male-threaded body portion of such basket sink strainer.

2. Background

A basket sink strainer has at its top an outturned flange whose lower surface is mounted against the upper surface of a flanged shoulder surrounding the sink drain hole of a kitchen sink. In assembly, the lower surface of the basket sink strainer's outturned flange and upper surface of the sink drain hole's flanged shoulder sandwich therebetween a putty bead that was applied to the flanged shoulder's upper surface prior to effecting such assembly. To complete the assembly, a large female-threaded ring, having a flanged upper surface, is appropriately engaged with the basket sink strainer's male-threaded body portion and appropriately tightened to effect tight engagement of the large female-threaded ring's flanged upper surface with the lower surface of the sink drain hole's flanged shoulder. If the sink strainer is properly assembled in concentric and superposed parallel relationships with the sink drain hole, the putty bead will be compressed uniformly to effect a proper water seal and water leakage will not occur beneath the peripheral lateral edge of the basket sink strainer's outturned flange and through the sink drain hole. The problem in the prior art is properly disposing and maintaining the basket sink stainer's outturned flange in concentric and superposed parallel relationships with the sink drain hole's flanged shoulder while tightening the large female-threaded ring upon the basket sink strainer's male-threaded body portion to effect proper water seal from the putty bead being compressed. However, metal-to-metal contact between the sink strainer's outturned flange and the drain hole's flanged shoulder while tightening the large female-threaded ring causes relative slippage therebetween resulting in excentric disposition of the basket sink strainer relative to the sink drain hole with the putty seal being broken with resulting leakage. Part of the putty seal may be wiped away upon tightening the large ring if superposed parallel relationship is not maintained between the sink strainer's outturned flange and the drain hole's flanged shoulder. Such consequent resulting leakage from such improper assembly mandates disassembly and removal of the sink strainer, cleaning away the old putty from such outturned flange and flanged shoulder, applying a new putty bead to the flanged shoulder and attempting proper reassembly of the sink strainer's outturned flange with the drain hole's flanged shoulder. Often, many time-consuming attempts must be made until proper assembly is effected.

SUMMARY OF THE INVENTION

Accordingly, the object of the invention is to contribute to the solution of the discussed problems in the prior art by providing a centering tool that disposes and maintains the sink strainer's outturned flange in concentric and superposed parallel relationships with the sink drain hole's flanged shoulder while tightening the large female-threaded ring upon the sink strainer's male-threaded body portion, with the result that proper water seal is effected by the putty bead being compressed.

BRIEF DESCRIPTION OF THE DRAWINGS

This object and other objects of the invention should be discerned and appreciated from the description of the preferred embodiment and operational description taken in conjunction with the drawings, wherein like reference numerals refer to similar parts throughout the several views, in which:

FIG. 2 is a bottom view of the centering tool;

FIG. 4 is a side elevational view showing the male-threaded adapter element having integral depending prongs.

DESCRIPTION OF THE PREFERRED EMBODIMENT

Figure 1:
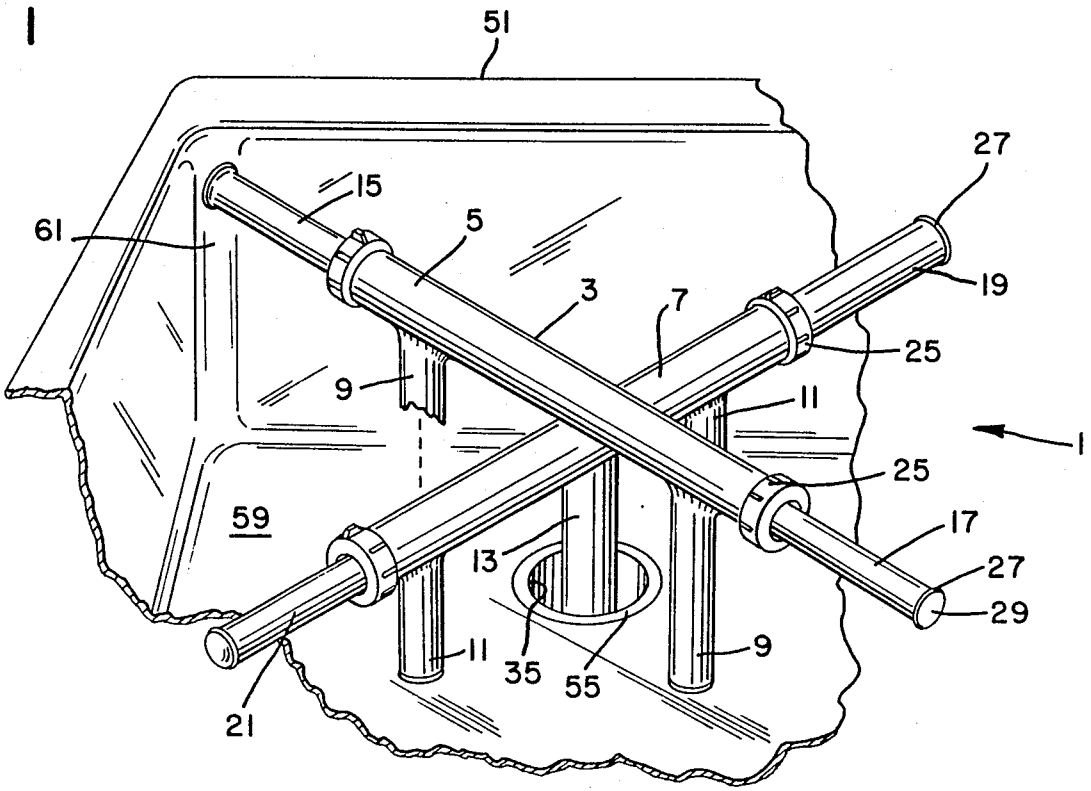
FIG. 1 is a perspective view showing the centering tool in operative use in a kitchen sink.
Figure 3:
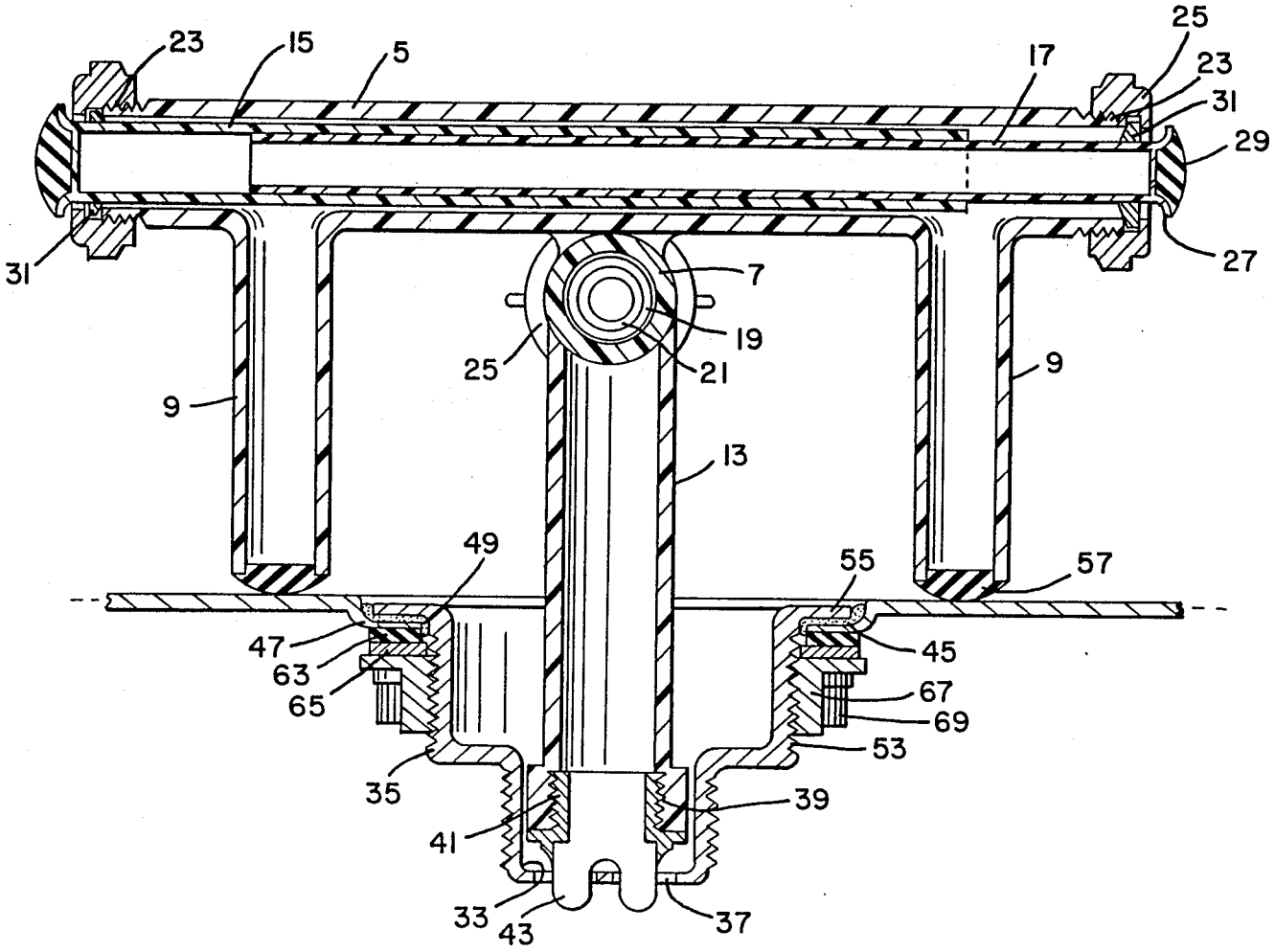
FIG. 3 is a sectional view taken along the line of the vertical plane through the longitudinal axes of the upper horizontal arm and depending tubular leg member.

In FIG. 1 of the drawings, reference numeral 1 generally refers to the basket sink strainer centering tool that is made of plastic or other suitable material. Centering tool 1 comprises a spider 3 of tubular construction, formed of upper and lower horizontal arms 5 and 7 in normal relationship to each other. Fixed to and depending from the arms 5 and 7 are respective feet 9 and 11. Fixed to and depending from the center of lower horizontal arm 7 is a tubular adapter member 13. Slidably received in telescopic relationship within upper horizontal arm 5 is an extensible tubular element 15. Slidably received in telescopic relationship within tubular element 15 is an extensible tubular element 17. Slidably received in telescopic relationship within lower horizontal arm 7 is an extensible tubular element 19. Slidably received in telescopic relationship within tubular element 19 is an extensible tubular element 21. Each of the terminal ends of the upper and lower horizontal arms 5 and 7 has a male-threaded portion 23 engaged by a female-threaded compression ring 25 mounted freely on each of the extensible tubular elements 15, 17, 19 and 21. Each of the terminal ends of the tubular elements 15, 17, 19 and 21 has a shouldered flange 27 carrying a pad 29 of rubber or other suitable material. The shouldered flanges 27 function as limit stops against which the compression rings 25 abut. Mounted on each of the tubular elements 15, 17, 19 and 21 is a beveled compression element 31. The compression elements 31 are interposed between the female-threaded compression rings 25 and the male-threaded end portions 23 of arms 5 and 7. After loosening its respective female-threaded compression ring 25, each of the tubular elements 15, 17, 19 and 21 can be adjustably moved in or out as required and then removably locked in such adjusted position by retightening compression ring 25 on its respective male-threaded end portion of arms 5 or 7, which thereby compresses its respective beveled compression element 31 to lock the respective tubular element in its adjusted position. The bottom or well 33 of the basket sink strainer 35 is defined by a reduced concentric portion having elongated arcuate slots 37 around the periphery of such well 33. The terminal end of the tubular leg member 13 defines an outwardly shouldered tapped portion 39 engaged by a male-threaded adapter element 41 having integral depending prongs 43. Both the wall of the well 33 complementally receives the outwardly shouldered portion 39, and the elongated slots complementally receive therethrough the depending prongs 43. There are usually 3 or 4 equally spaced elongated slots in the well 33. In operative use, an appropriate adapted element 41 having the requisite number of prongs 43 would be selected and threaded into the tapped portion 39 of the leg member 13.

OPERATIONAL DESCRIPTION

Preparatory to operational use of the centering tool 1, one would apply a bead of putty 45 to the upper surface of the flanged shoulder 47 of the drain hole 49 of the sink 51. Then the male-threaded body portion 53 of the basket sink strainer 35 is appropriately disposed through the sink drain hole 49 such that the lower surface of the outturned flange 55 is emplaced upon the putty bead 45. Then the centering tool 1 is appropriately disposed within the sink 51 such that the depending prongs 43 of the adapter element 41, carried by the tubular leg member 13 depending from the center of lower horizontal arm 7, operatively and complementally engage the elongated arcuate slots 37 in the well 33 of the sink strainer 35, and such that the pads 57, carried on the terminal ends of depending feet 9 and 11, rest upon the bottom surface 59 of the sink 51. The spider 3, if not having been theretofore, is appropriately oriented such that the pads 29, carried by the shouldered flanges 29 on the terminal ends of the tubular elements 15, 17, 19 and 21, will make abutting contacts against the corners 61, defined by the lateral walls of the sink 51. All the female-threaded compression rings 25 are appropriately loosened and the diametrically opposite tubular elements 15 and 17 are appropriately extended equal distances, as required, to effect tight contact with the corners 61 of the sink 51. Then their respective compression rings 25 are appropriately retightened to lock the tubular elements 15 and 17 in their adjusted positions; and then the diametrically opposite tubular elements 19 and 21 are appropriately extended equal distances, as required, to effect tight contact with the corners 61 of the sink 51, and their compression rings 25 are appropriately retightened to lock the tubular elements 19 and 21 in their adjusted positions. The outturned flange 53 of the sink strainer 35 thusly will be disposed and maintained both in concentric relationship with the flanged shoulder 47 of the sink drain hole 49 and in superposed parallel relationship thereto. To complete the assembly of the basket sink strainer 35, a rubber gasket 63 and washer 65 are interposed between the lower surface of the flanged shoulder 47 of the sink drain hole 49 and the flanged upper surface of the large female-threaded ring 67 loosely engaged with the male-threaded body portion 53 of the sink strainer 35. Optionally, ring 67, sandwiching gasket 63 and washer 65 therebetween, can be loosely settled theretofore on the threaded body portion 53. To complete the assembly, a spanner wrench is appropriately applied to the ears or lugs 69 to tighten 67.

I claim:

1. A centering tool for disposing and maintaining a basket sink strainer having a bottom well with slots in concentric and superposed parallel relationships with respect to a sink drain hole of a sink having a bottom surface and walls defining corners for subsequent securement of the basket sink strainer with the sink drain hole; said centering tool comprising spider means and prong means connected to said spider means; said spider means having adjustably positionable and lockable extensible means adapted to engage said corners of said sink while said prong means engages said slots whereby said spider means is adjustable to center said strainer in said drain hole.

2. A centering tool in accordance with claim 1, wherein said spider means have depending feet means engaging said bottom surface of said sink.

3. A centering tool in accordance with claim 1, wherein said spider means have arms slidably mounting said extensible means.

4. A centering tool in accordance with claim 3, wherein said arms are in normal relationship.

5. A centering tool in accordance with claim 1, wherein said spider means have upper and lower arms securably mounted and slidably mounting said extensible means.

6. A centering tool in accordance with claim 5, wherein said arms are in normal relationship.

7. A centering tool in accordance with claim 1, wherein said prong means depend from said spider means.

8. A centering tool in accordance with claim 7, wherein said prong means comprise a leg member and prongs, wherein said leg member depends from said spider means and said leg member carries said prongs.

9. A centering tool in accordance with claim 8, wherein said leg member depends from the center of said spider means.

10. A centering tool in accordance with claim 1, wherein said extensible means comprise extensible tubular elements and wherein said spider means slidably mount said extensible tubular elements.

11. A centering tool in accordance with claim 1, wherein said spider means have horizontal arms slidably mounting said extensible means.

12. A centering tool in accordance with claim 1, wherein said spider means have upper and lower horizontal arms, securably mounted wherein said arms are in normal relationship to each other and wherein said arms slidably mount said extensible means.

13. A centering tool in accordance with claim 12, wherein said arms are of tubular construction.

14. A centering tool in accordance with claim 13, wherein said extensible means conprise extensible tubular elements and wherein said upper and lower tubular arms slidably mount said extensible tubular elements.

15. A centering tool in accordance with claim 14, wherein said slidable mounting of said extensible tubular members is in telescopic relationship.

16. A centering tool in accordance with claim 15, wherein said arms have threaded end portion means, wherein said tubular elements carry threaded compression ring means and wherein said compression ring means engage said threaded end portion means to releasably lock said extensible tubular elements.

17. A centering tool in accordance with claim 16, wherein said arms have depending feet engaging said bottom surface of said sink.

18. A centering tool in accordance with claim 17, wherein said prong means comprise a leg member and prongs, wherein said leg member depend from the center of said lower tubular arm and wherein said centrally depending leg member carries said prongs.

* * * * *